US010517446B1

(12) United States Patent
Garcia

(10) Patent No.: US 10,517,446 B1
(45) Date of Patent: Dec. 31, 2019

(54) WALL MOUNTED DEVICE THAT HOLDS A WET WIPE DISPOSABLE BAG

(71) Applicant: Rolando Garcia, Miami, FL (US)

(72) Inventor: Rolando Garcia, Miami, FL (US)

( * ) Notice: Subject to any disclaimer, the term of this patent is extended or adjusted under 35 U.S.C. 154(b) by 0 days.

(21) Appl. No.: 16/028,139

(22) Filed: Jul. 5, 2018

(51) Int. Cl.
*A47K 10/42* (2006.01)
*B65D 83/08* (2006.01)
*A47K 10/32* (2006.01)

(52) U.S. Cl.
CPC ..... *A47K 10/421* (2013.01); *B65D 83/08* (2013.01); *A47K 2010/3266* (2013.01)

(58) Field of Classification Search
USPC ..... 221/33–63
See application file for complete search history.

(56) References Cited

U.S. PATENT DOCUMENTS

2006/0102641 A1* 5/2006 Cittadino ..... A47K 10/422 221/45

2015/0196176 A1* 7/2015 Felix ..... A47K 10/3618 221/46

* cited by examiner

*Primary Examiner* — Gene O Crawford
*Assistant Examiner* — Ayodeji T Ojofeitimi
(74) *Attorney, Agent, or Firm* — Ruben Alcoba

(57) ABSTRACT

A wall mounted device that holds a wet wipe disposable bag. The device is a moldable rectangular sheet of material that has a first and a second end. The rectangular sheet measures approximately ten inches in length by seven inches in width. The sheet is folded lengthwise as follows: first, at about the four inch juncture from the first end of the rectangular sheet the sheet is bent in a first direction that is at about an angle that is between seventy to eighty degree; and then at about the six point two five inch juncture from the first end of the rectangular sheet the sheet is bent toward the first direction at about an angle that is between seventy to eighty degree. And, the second end of the rectangular sheet of material centrally defines an aperture along the width of the second end of the sheet and the aperture runs towards the first end of the rectangular sheet, the aperture is from about three inches to about four point two five inches in width and it runs toward the first end for approximately three inches in length.

7 Claims, 3 Drawing Sheets

WALL MOUNTED DEVICE THAT HOLDS A WET WIPE DISPOSABLE BAG

BACKGROUND

The present invention is directed to a wall mounted device that holds a wet wipe disposable bag.

The inventor of the present invention conceived the device while sitting in the toilet and realizing the need to have his wet wipes at a reachable distance without having to reach backwards and guess where the disposable wet wipes would be on the platform of the tank of the toilet.

For the foregoing reasons there is a need for a wall mounted device that holds a wet wipe disposable bag.

SUMMARY

The present invention describes a wall mounted device that holds a wet wipe disposable bag.

The wall mounted device is formed by providing a moldable rectangular sheet of material that measures approximately ten inches in length by seven inches in width. The rectangular sheet of material has a first and a second end and the sheet is folded lengthwise as follows: first at about the four inch juncture from the first end of the rectangular sheet the sheet is bent in a first direction that is at about an angle that is between seventy to eighty degree; and then at about the six point two five inch juncture from the first end of the rectangular sheet the sheet is bent toward the first direction at about an angle that is between seventy to eighty degree. The second end of the rectangular sheet of material is cut so that an aperture is defined centrally along the width of the second end of the sheet and the aperture runs towards the first end of the rectangular sheet. The aperture is from about three inches to about four point two five inches in width and it runs toward the first end for three inches in length. The aperture tapers inward from a position that is at a midpoint in length so that it matches a curvature of a lid of the wet wipe disposable bag.

In preferred embodiments of the wall mounted device, all edges of the devices will be curved in order to prevent injury.

The wall mounted device is attached to a wall. The wall attachment can be performed by using wall screws or an adhesive.

The wall mounted device can be made of any moldable material. The material can be a polymer, polymethyl methacrylate, or a metal such as stainless steel.

An object of the present invention is to provide a wall mounted device that will allow a user to place a wet wipe disposable bag at a convenient location when using a toilet.

DRAWINGS

These and other features, aspects, and advantages of the present invention will become better understood with regard to the following description, appended claims, and drawings where:

DESCRIPTION

Figure 1:
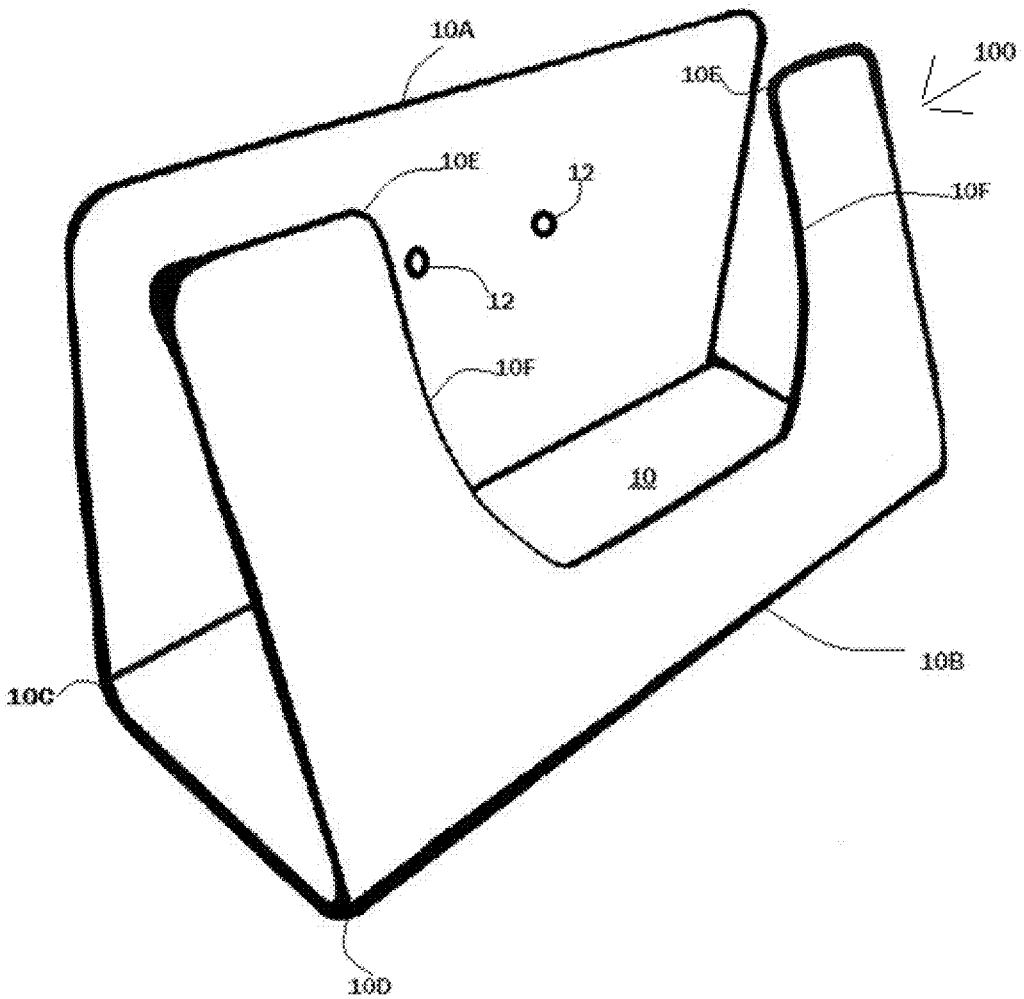
FIG. 1 is a perspective view of the present invention.
Figure 2:
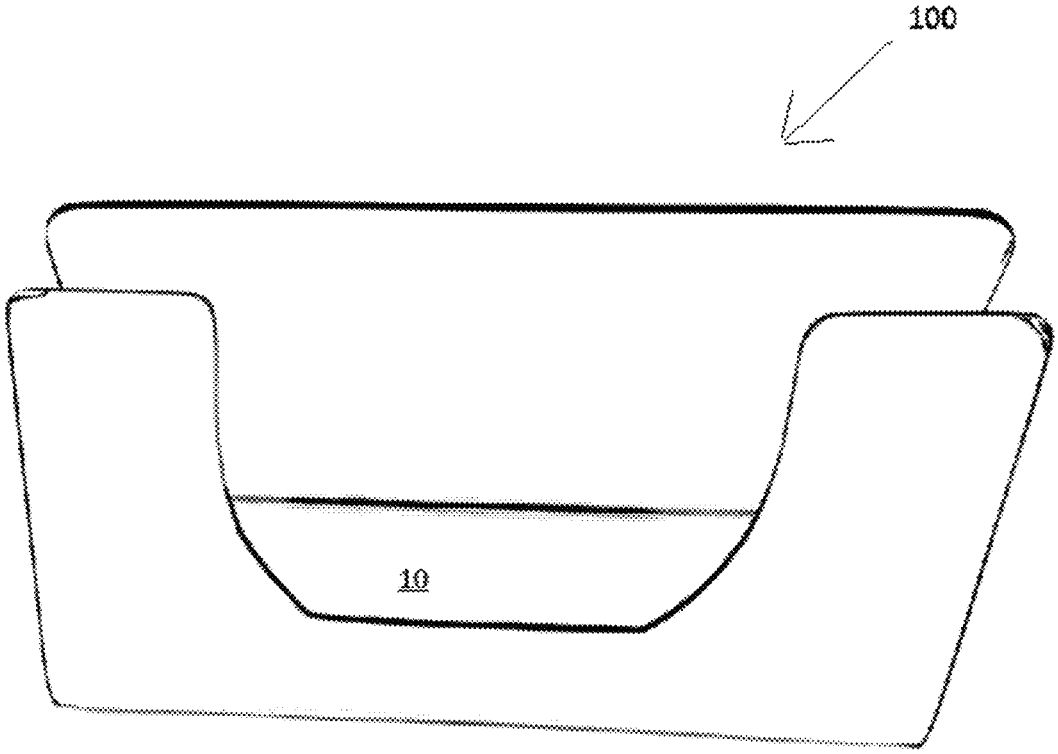
FIG. 2 is a second perspective view of the present invention.
Figure 3:
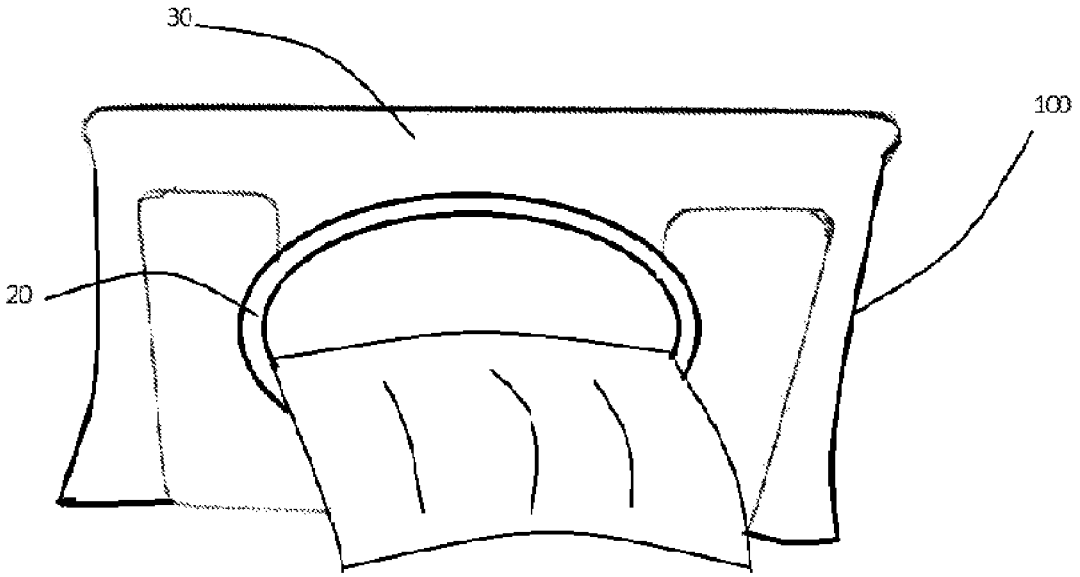
FIG. 3 is a perspective view of the present invention wherein a wet wipe disposable bag inserted within the present invention.

As seen in FIGS. 1-3, the present invention is directed to a wall mounted device that holds a wet wipe disposable bag.

The device 100 comprises a moldable rectangular sheet of material 10 that has a first 10*a* and a second end 10*b*, the sheet measures approximately ten inches in length by seven inches in width, the sheet is folded lengthwise as follows: first, at about the four inch juncture 10*c* from the first end 10*a* of the rectangular sheet 10 the sheet 10 is bent in a first direction that is at about an angle that is between seventy to eighty degree; and then at about the six point two five inch juncture 10*d* from the first end 10*a* of the rectangular sheet 10 the sheet is bent toward the first direction at about an angle that is between seventy to eighty degree, and the second end 10*b* of the rectangular sheet of material 10 centrally defines an aperture 10*e* along the width of the second end of the sheet and the aperture runs towards the first end 10*a* of the rectangular sheet 10, the aperture is from about three inches to about four point two five inches in width and it runs toward the first end for approximately three inches in length, and the aperture tapers inward 10*f* from a position that is at a midpoint from the second end 10*b* in length so that it matches a curvature of a lid 20 of the wet wipe disposable bag 30.

The device comprises of an attachment 12 for attaching the device 100 to a wall. The attachment 12 can be a screw or an adhesive.

The midpoint of the aperture 10*f* is approximately one and a half inches from the second end 10*b*.

The device is made of a moldable material, a polymer, or polymethyl methacrylate a/k/a PLEXIGLAS.

An advantage of the present invention is that it provides a wall mounted device that allows a user to place a wet wipe disposable bag at a convenient location when he or she uses a toilet.

While the inventor's above description contains many specificities, these should not be construed as limitations on the scope, but rather as an exemplification of several preferred embodiments thereof. Many other variations are possible. Accordingly, the scope should be determined not by the embodiments illustrated, but by the appended claims and their legal equivalents.

What is claimed is:

1. A wall mounted device that holds a wet wipe disposable bag, the device comprises:

a moldable rectangular sheet of material that has a first and a second end, the sheet measures approximately ten inches in length by seven inches in width, the sheet having a front wall (second end) and a back wall (front end), the bottom wall forming an angle between 70 to 80 degrees with each of the front wall (second end) and the back wall (first end), and the second end of the rectangular sheet of material centrally defines an aperture along the width of the second end of the sheet and the aperture runs towards the first end of the rectangular sheet, the aperture is from about three inches to about four point two five inches in width and it runs toward the first end for approximately three inches in length, and the aperture tapers inward from a position that is at a midpoint from the second end in length so that it matches a curvature of a lid of the wet wipe disposable bag.

2. The wall mounted device that holds a wet wipe disposable bag of claim 1, the device comprises of an attachment for attaching the device to a wall.

3. The wall mounted device that holds a wet wipe disposable bag of claim 2, wherein the midpoint is one and a half inches from the second end.

4. The wall mounted device that holds a wet wipe disposable bag of claim 3, wherein the device is made of a moldable material.

5. The wall mounted device that holds a wet wipe disposable bag of claim 4, wherein the moldable material is a polymer.

6. The wall mounted device that holds a wet wipe disposable bag of claim 4, wherein the moldable material is a stainless steel.

7. The wall mounted device that holds a wet wipe disposable bag of claim 4, wherein the moldable material is a polymethyl methacrylate.

* * * * *